US006674228B2

(12) United States Patent
Chen et al.

(10) Patent No.: US 6,674,228 B2
(45) Date of Patent: Jan. 6, 2004

(54) MULTI-LAYER COMMON LENS ARRANGEMENT FOR MAIN FOCUS LENS OF MULTI-BEAM ELECTRON GUN

(75) Inventors: Hsing-Yao Chen, Fox River Grove, IL (US); Yu-Kun Ma, Taoyuan (TW); Hsiang-Lin Chang, Taoyuan (TW); Chun-Hsien Yeh, Taipei (TW)

(73) Assignee: Chunghwa Pictures Tubes, Ltd., Taoyuan (TW)

( * ) Notice: Subject to any disclaimer, the term of this patent is extended or adjusted under 35 U.S.C. 154(b) by 83 days.

(21) Appl. No.: 10/117,301

(22) Filed: Apr. 4, 2002

(65) Prior Publication Data

US 2003/0189398 A1 Oct. 9, 2003

(51) Int. Cl.[7] ..... H01J 29/50
(52) U.S. Cl. ..... 313/414; 313/412
(58) Field of Search ..... 313/412, 414, 313/426

(56) References Cited

U.S. PATENT DOCUMENTS

| | | | | |
|---|---|---|---|---|
| 3,524,094 A | | 8/1970 | Hasker et al. | 313/76 |
| 3,801,817 A | | 4/1974 | Goodman | 250/365 |
| 4,177,462 A | | 12/1979 | Chung | 340/703 |
| 4,193,071 A | | 3/1980 | Hasegawa et al. | 340/723 |
| 4,225,880 A | | 9/1980 | Goodman | 358/66 |
| 4,234,814 A | | 11/1980 | Chen et al. | 313/412 |
| 4,247,869 A | | 1/1981 | Culter et al. | 358/67 |
| 4,408,223 A | | 10/1983 | Midland | 358/67 |
| 4,439,735 A | | 3/1984 | Alvite et al. | 324/404 |
| 4,507,585 A | | 3/1985 | Inoue et al. | 313/471 |
| 4,635,106 A | | 1/1987 | Shinkai | 358/68 |
| 4,701,677 A | | 10/1987 | Ashizaki et al. | 315/382 |
| 5,113,112 A | | 5/1992 | Shimoma et al. | 313/412 |
| 5,142,189 A | * | 8/1992 | Sugahara et al. | 313/414 |
| 5,159,240 A | | 10/1992 | Chen et al. | 315/14 |
| 5,182,492 A | | 1/1993 | Chen | 315/14 |
| 5,204,585 A | | 4/1993 | Chen | 315/15 |
| 5,220,239 A | | 6/1993 | Chen | 313/414 |
| 5,223,764 A | | 6/1993 | Chen | 313/414 |
| 5,241,240 A | | 8/1993 | Chen et al. | 313/414 |
| 5,316,879 A | | 5/1994 | Berger et al. | 430/5 |
| 5,327,044 A | | 7/1994 | Chen | 313/433 |
| 5,350,967 A | | 9/1994 | Chen | 313/413 |
| 5,376,505 A | | 12/1994 | Berger et al. | 430/296 |
| 5,424,173 A | | 6/1995 | Wakabayashi et al. | 420/296 |
| 5,483,128 A | | 1/1996 | Chen | 315/382 |
| 5,532,547 A | | 7/1996 | Park et al. | 313/414 |
| 5,593,761 A | | 1/1997 | Itoh et al. | 428/210 |
| 5,689,158 A | | 11/1997 | Chen | 315/382.1 |
| 6,153,970 A | | 11/2000 | Chen et al. | 313/412 |

* cited by examiner

*Primary Examiner*—Vip Patel
(74) *Attorney, Agent, or Firm*—Emrich & Dithmar

(57) ABSTRACT

An inline electron gun for use in a multi-beam electron gun as in a color cathode ray tube (CRT) includes a main focus lens for focusing the electron beams on the CRT's display screen for providing a video image. The main focus lens includes plural charged grids aligned in a spaced manner along the electron gun's longitudinal axis through which plural (typically three) electron beams are directed. One or more of these charged grids includes at least two aligned common apertures for passing the three electron beams. The layered common aperture arrangement allows for increasing the length of the electron gun as well as the effective diameter of the electron gun's main focus lens for improved video image resolution without introducing electron beam astigmatism.

19 Claims, 9 Drawing Sheets

42
40
36
36a 30
26
28
$V_A$ 35 SOURCE
7b
64a
64b
64c
G4
67
62
50
65
61
57
Z
Y
X
58
60a
60b
60c
59
$V_F$ 34 SOURCE
G3
56b
56c
56a
54b
7b
54c
$V_G$ 33 SOURCE
54a
G2
52b
52c
52a
G1
$K_R$
$K_G$
$K_B$

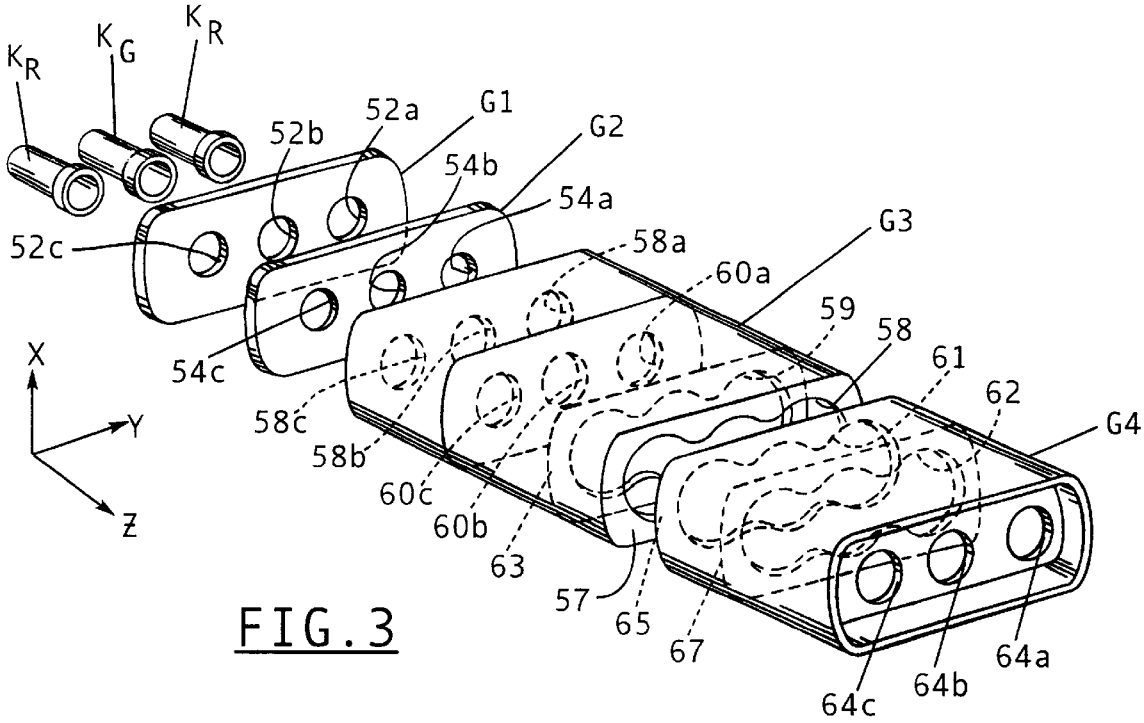
FIG.3
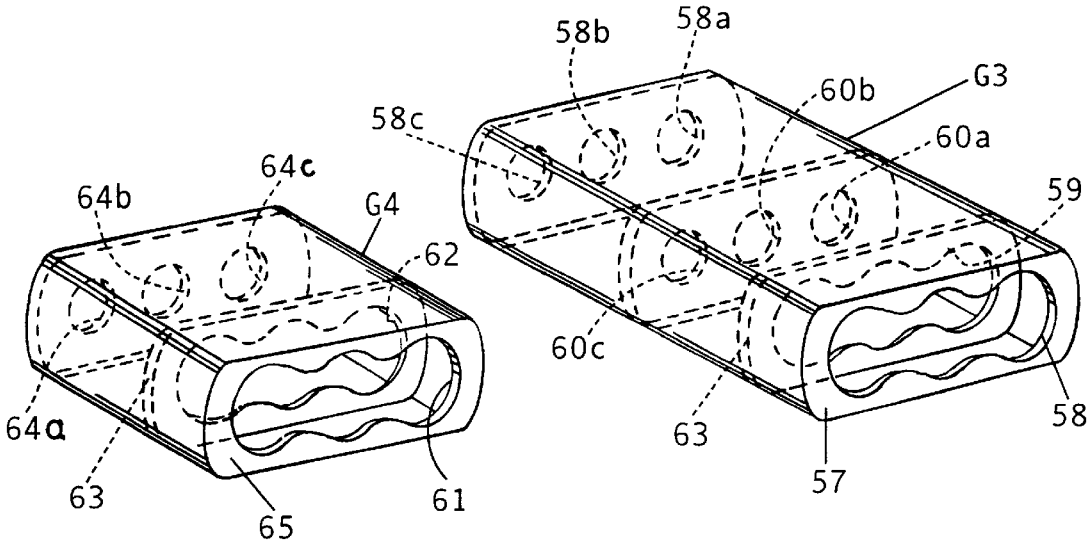
FIG.2b
FIG.2a 42
40
36
36a 30
26
28
$V_A$ 35 SOURCE
94a
94b
94c
G6
93
92
95
90
70
4a
4b
86
85
83
84a
84b
88
$V_F$ 34 SOURCE
84c
G5
82b
80b
82a
82c
G4
80a
80c
78a
78b
74b
76b
78c
G3
76a
76c
$V_G$ 33 SOURCE
G2
74a
74c
72a
72b
72c
G1
$K_R$
$K_G$
$K_B$

MULTI-LAYER COMMON LENS ARRANGEMENT FOR MAIN FOCUS LENS OF MULTI-BEAM ELECTRON GUN

FIELD OF THE INVENTION

This invention relates generally to multi-beam electron guns as used in color cathode ray tubes (CRTs) and is particularly directed to a multi-layer common lens arrangement in one or more charged grids in the main focus lens of a CRT electron gun.

BACKGROUND OF THE INVENTION

A typical color CRT employs a multi-beam electron gun which directs three inline electron beams on the inner surface of the CRT's glass display screen. A magnetic deflection yoke disposed outside of the CRT's glass envelope sweeps the three electron beams in unison across the display screen in a raster-like manner. The three electron beams are aligned generally horizontally, or in the direction of each sweep across the CRT's display screen. The energetic electrons incident upon a phosphor coating disposed on the display screen's inner surface produce a video image.

Electron guns are characterized as having X-, Y-, and Z-axes respectively aligned along the width, height and length of the electron gun structure. These axes are shown in FIG. 1 which is a longitudinal sectional view of a prior art bipotential inline electron gun 10 incorporating a common lens arrangement in its main focus lens. The Y-axis aligned with the height of the bipotential inline electron gun 10 is perpendicular to the plane of the drawing sheet. In general, the larger the electron gun is along its X- and Y-axes, or the larger its diameter, the better the resolution of the video image presented on the CRT's display screen. Over the past several years, the design of high resolution color CRT electron guns has evolved from the individual beam main lens design to the common lens design for the purpose of increasing the effective size of the electron gun. In the individual beam type of main lens design, each of the three electron beams (red, blue, green) is directed through an individually defined lens space without sharing the space with the other beams. In the common lens design, each of the three electron beams is directed through its own individual beam path as well as through a shared focusing region defined by a common beam passing aperture.

Referring to FIG. 1, there is shown a longitudinal sectional view of a prior art bipotential inline electron gun 10 incorporating a common lens arrangement in its main focus lens. Electron gun 10 includes an electron beam source typically comprised of three cathodes: $K_R$ (red), $K_G$ (green) and $K_B$ (blue). Each cathode emits electrons which are focused to a crossover along the axis of the beam by the effect of an electrode commonly referred to as the G2 screen grid. An electrode known as the G1 control grid is disposed between the cathodes and the G2 screen grid and is operated at a negative potential relative to the cathodes and serves to control the intensity of the electron beams in response to the application of a video signal to the cathodes. Each of the G1 control and G2 screen grids includes three respective aligned apertures 12*a*, 12*b*, 12*c* and 14*a*, 14*b*, 14*c*, with corresponding apertures in each electrode in common alignment for passing a respective one of the red, green or blue color generating electron beams. The G2 screen grid is connected to and charged by a $V_G$ voltage source 33.

Electron gun 10 further includes a G3 electrode and a G4 electrode disposed about the three electron beams and along the path of the energetic electrons as they travel toward a display screen 40 disposed on a forward portion of the CRT's glass envelope (which is not shown in the figure for simplicity). The G3 grid is connected to and charged by a $V_F$ focus voltage source 34, while the G4 grid is coupled to and charged by a $V_A$ accelerating, or anode, voltage source 35. The lower end of the G3 grid in facing relation to the G2 screen grid forms, in combination with the G1 control grid and the G2 screen grid, a beam forming region for forming the three groups of energetic electrons emitted by the $K_R$, $K_G$ and $K_B$ cathodes into three spaced electron beams. The lower end of the G3 grid includes three inline, spaced apertures 16*a*, 16*b* and 16*c* through each of which is directed a respective electron beam.

While the G1 control and G2 screen grids are generally flat, the G3 grid and a G4 grid are cup-like in shape. Disposed within the G3 grid is a second trio of beam passing apertures 20*a*, 20*b* and 20*c*, through each of which is directed a respective one of the electron beams. The G3 and G4 grids form the electron gun's main focus lens. Disposed on the upper portion of the G3 grid in facing relation to the G4 grid is an elongated common beam passing aperture 18 through which all three electron beams are directed. Beam passing aperture 18 extends substantially the entire width and height of the G3 grid and typically has a chain link shape. This chain link shape includes three spaced curvilinear enlarged portions through each of which is directed a respective one of the electron beams. This chain link shaped common beam passing aperture is shown in figures discussed in the following paragraphs and is described in detail below. The common beam passing aperture may take on other common forms, e. g., race track, dog bone or elliptical, although these other shapes are not shown in the figures for simplicity.

The G4 grid also includes an elongated common beam passing aperture 22 in facing relation to the beam passing aperture 18 of the G3 grid. Disposed within the G4 grid in spaced relation are three inline beam passing apertures 24*a*, 24*b* and 24*c* through each of which is directed a respective one of the electron beams. Disposed on the upper end portion of the G4 grid is a conductive support, or convergence, cup 26 which includes plural bulb spacers 28 disposed about its circumference in a spaced manner. The support cup 26 and bulb spacer 28 combination is conventional and serves to securely maintain electron gun 10 in position in the neck portion of a CRT's glass envelope. Each of the aforementioned grids is coupled to and supported by glass beads (also not shown for simplicity) disposed in the glass envelope's neck portion.

After being subjected to the electrostatic fields produced by the accelerating and focusing voltages applied by the aforementioned grids, the focused electron beams are then directed through a magnetic deflection yoke 30 for deflecting the electron beams in a raster-like manner across a phosphor coating, or layer, 40 on the inner surface of the CRT's display screen, or glass faceplate, 42. Disposed adjacent the inner surface of the CRT's display screen 42 is a shadow mask 36 having a larger number of apertures 36*a* therein and serving as a color selection electrode.

By directing all three electron beams through a common beam passing aperture, the effective width and height, i.e., diameter, of the electron gun is increased to provide improved video image resolution. Because the electron gun is disposed within the narrow neck portion of the CRT's glass envelope, the common lens design overcomes prior limits on the size, i.e., height and width, of the individual lens-type electron gun.

The length of the electron gun along its Z-axis may also be increased. However, increasing the length of the electron gun along its Z-axis creates a large asymmetric astigmatism which reduces video image resolution. Electron beam astigmatism is defined in terms of the difference between the horizontal focus voltage and the vertical focus voltage, or:

$$\text{astigmatism}=V_{FH}-V_{FV}$$

where $V_{FH}$=horizontal focus voltage, and $V_{VF}$=vertical focus voltage.

The present invention addresses the aforementioned limitations of the prior art by increasing the effective electrostatic focusing field applied to the electron beams by increasing the effective diameter of the electron gun and compensating for this increase in size by increasing the gun's length. By electrostatically compensating for the electron gun's increased effective diameter, electron beam astigmatism is also compensated for and video image resolution is improved.

OBJECTS AND SUMMARY OF THE INVENTION

Accordingly, it is an object of the present invention to provide improved electron beam focusing in a multi-beam electron gun such as incorporated in a color CRT.

It is another object of the present invention to electrostatically increase the effective diameter of the main focus lens of an electron gun to compensate for increased electron gun length without increasing electron beam astigmatism for improved electron beam focusing on the display screen of a CRT.

Yet another object of the present invention is to provide a layered common lens arrangement in a multi-beam electron gun including one or more charged grids each having plural common apertures through which the electron beams are directed for improved focusing of the electron beams on a display screen upon which a video image is presented.

A further object of the present invention is to compensate for electron beam astigmatism in a video image produced by plural electron beams directed by an electron gun on a display screen such as in a color CRT, where the astigmatism arises from increasing the length of the electron gun without increasing the electron gun's diameter.

A still further object of the present invention is to improve resolution of a video image produced by plural electron beams directed by an electron gun onto a display screen by increasing the electron gun's length without increasing its diameter or the focus voltage.

The present invention contemplates a charged electrode in an electron gun forming an electrostatic focusing field for focusing plural electron beams on a display screen of a color cathode ray tube (CRT) in forming a video image on the screen, wherein the plural electron beams are directed along respective parallel axes, the electrode comprising a hollow housing including a first wall for defining three inline apertures and a thin side wall forming lateral portions of the housing, wherein each of the inline apertures is aligned with a respective one of the axes for passing a respective one of the electron beams; plural second walls disposed in the hollow housing and extending inwardly toward the electron beam axes from the side wall, wherein the plural second walls are disposed in a spaced manner along the electron beam axes; and an elongated common aperture in each of the second walls, wherein the common apertures are aligned in a spaced manner along the electron beam axes and the electron beams are directed through the aligned common apertures, and wherein the plural walls increase the effective radius of the electrostatic focusing field of the electrode and the length of the electrostatic focusing field along the axes for improved electron beam focusing on the display screen.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIGS. 2*a* and 2*b* are perspective views, shown partially in phantom, respectively of the G3 and G4 grids used in the bipotential electron gun of FIG. 2;

FIG. 3 is a partial perspective view shown partially in phantom of the inventive inline bipotential electron gun shown in FIG. 2;

DETAILED DESCRIPTION OF THE PREFERRED EMBODIMENTS

Figure 1:
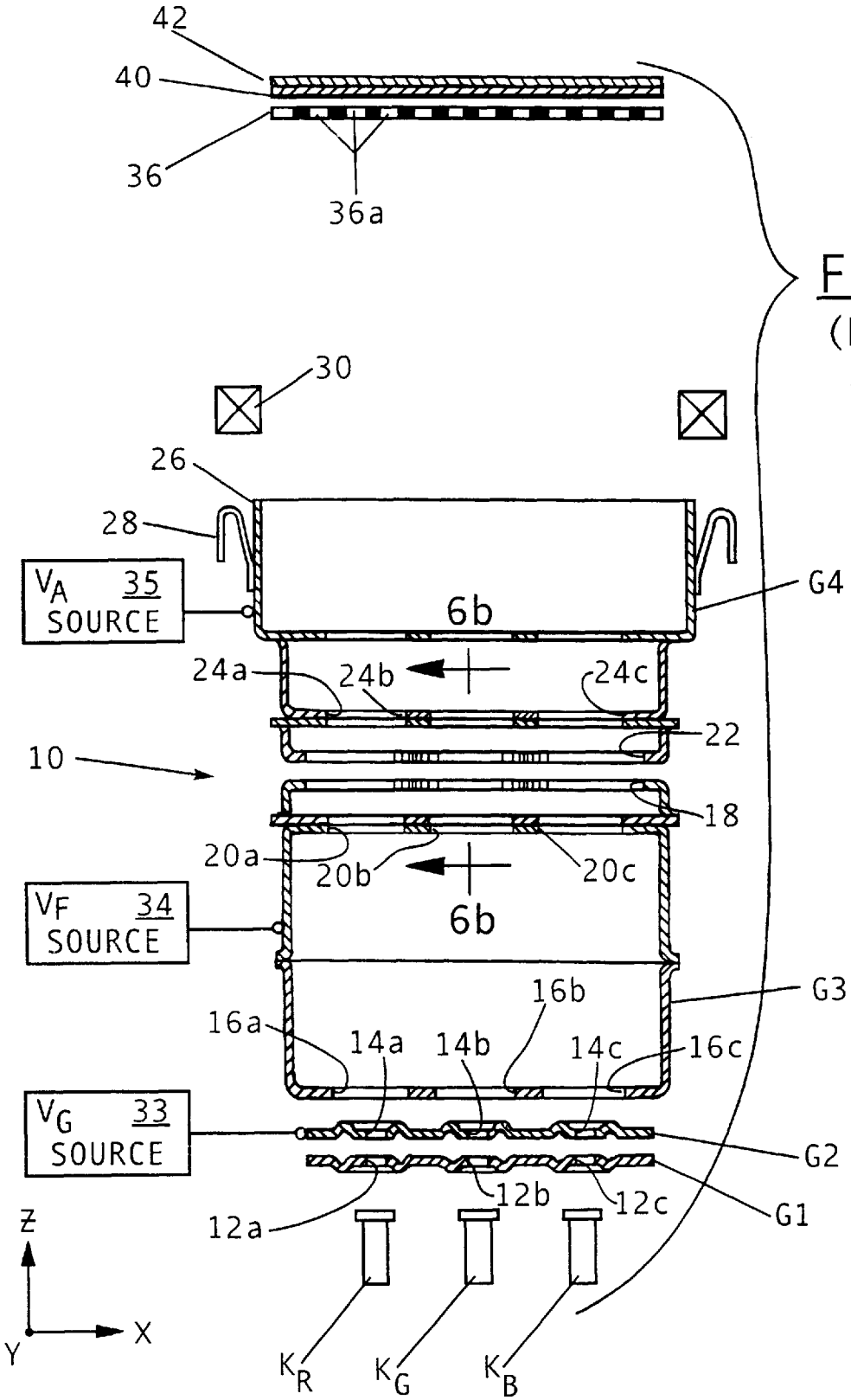
FIG. 1 (PRIOR ART)
FIG. 1 is a longitudinal sectional view of a prior art inline bipotential electron gun incorporating a common lens focusing arrangement for plural electron beams produced by the electron gun and directed onto a display screen for providing a video image.
Figure 2:
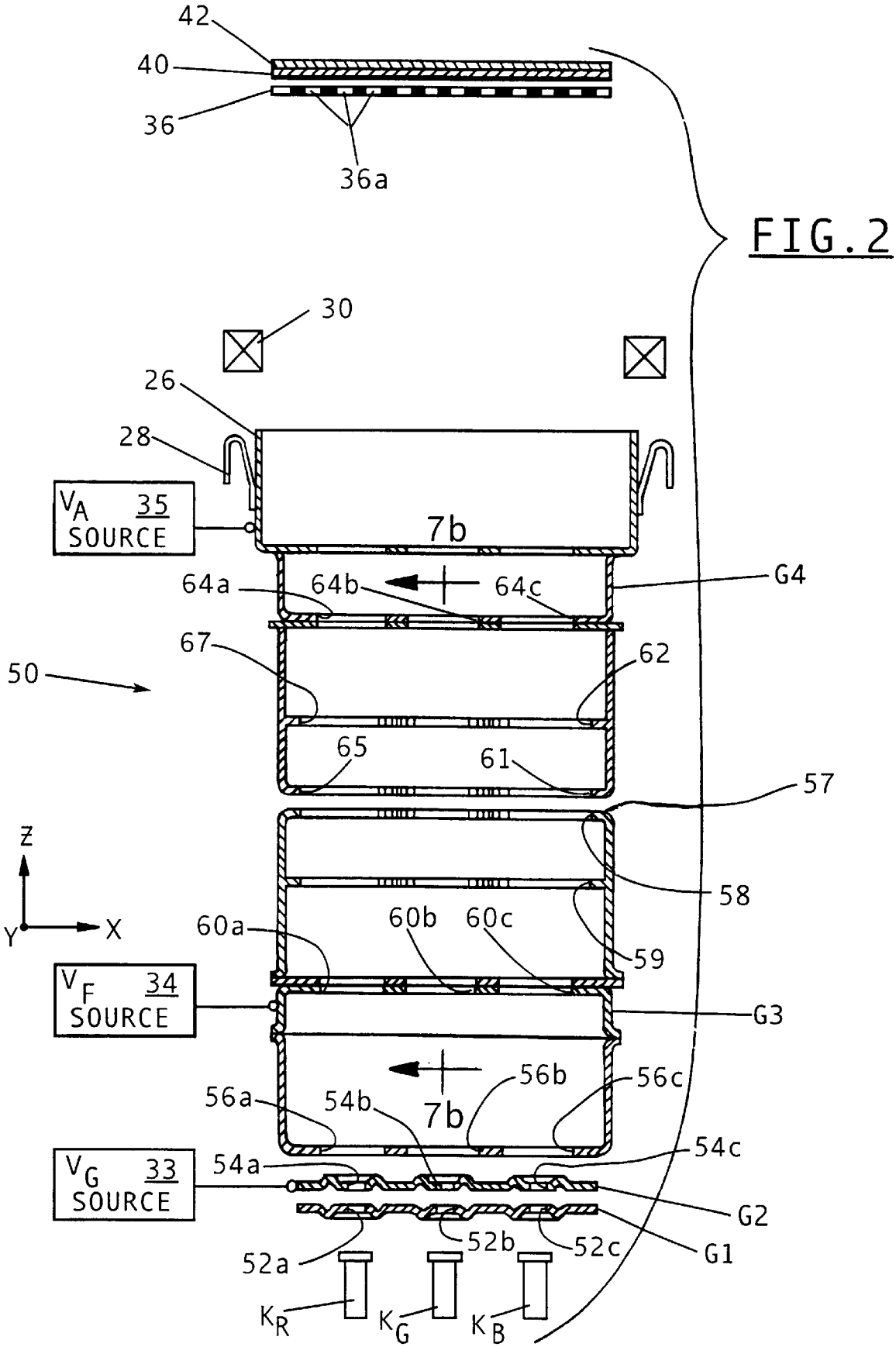
FIG. 2 is a longitudinal sectional view of an inline bipotential electron gun incorporating a multi-layer common aperture arrangement in its main focus lens in accordance with the principles of the present invention.

Referring to FIG. 2, there is shown a longitudinal sectional view of an inline bipotential electron gun 50 incorporating a multi-layer common lens arrangement in its main focus lens in accordance with the principles of the present invention. A partial perspective view of the inventive inline bipotential electron gun 50 shown partially in phantom is shown in FIG. 3. Elements shown in FIG. 2 which are common to corresponding elements shown in the prior art inline bipotential electron gun 10 of FIG. 1 are identified by the same element number or identifying indicia. Thus, the inventive inline bipotential electron gun 50 shown in FIG. 2 also includes three inline cathodes $K_R$, $K_G$ and $K_B$. A G1 control grid and a G2 screen grid each include respective trios of inline beam passing apertures 52*a*, 52*b*, 52*c* and 54*a*, 54*b*, 54*c*. A lower portion of a G3 grid in facing relation to the G2 screen grid similarly includes three inline spaced beam passing apertures 56*a*, 56*b* and 56*c*. The G3 grid further includes three inner inline beam passing apertures 60*a*, 60*b* and 60*c* each of which is aligned with a respective aperture on the lower portion of the G3 grid and passes a respective electron beam. A $V_G$ voltage source 33 is coupled to and charges the G2 screen grid, while a $V_F$ focus voltage source 34 is coupled to and charges the G3 grid. The G1 control and G2 screen grids in combination with the low end portion of the G3 grid comprises a beam forming region (BFR) of electron gun 50.

In accordance with the present invention, disposed on the upper portion of the G3 grid is an end wall 57 having therein a first elongated common beam passing aperture 58. In addition, a second elongated common beam passing aperture 59 is formed in an inner wall 63 disposed within the G3 grid and in alignment with the first common beam passing aperture 58. Referring to FIG. 2*a*, there is shown partially in phantom a perspective view of the G3 grid incorporated in the bipotential electron gun 50 of FIG. 2. As shown in FIG. 2*a*, the first elongated common beam passing aperture 58 has a chain link shape with three spaced enlarged curvilinear portions disposed along its length. Each enlarged portion of the first elongated common beam passing aperture 58 is aligned with a respective one of the G3 grid's inner beam passing apertures 60*a*, 60*b* and 60*c*. Each electron beam is thus directed through a respective one of the inner electron beam passing apertures 60*a*, 60*b* and 60*c* in the G3 grid as well as through a respective one of the enlarged portions of the first elongated common beam passing aperture 58 in alignment with a respective one of the inner beam passing apertures. The G3 grid's second elongated common beam passing aperture 59 may be of the same size and shape as the first elongated beam passing aperture 58.

The inventive bipotential electron gun 50 further includes a G4 grid coupled to and charged by a $V_A$ anode, or accelerating, voltage source 35. The high end of the G3 grid in combination with the G4 grid forms the main focus lens of bipotential electron gun 50. The G4 grid also includes a first elongated common beam passing aperture 61 disposed in an end wall 65 on its lower end portion in facing relation to the G3 grid as well as a second elongated common beam passing aperture 62 disposed in an inner wall 67 within the grid. The G4 grid further includes three generally circular, inline, spaced beam passing apertures 64*a*, 64*b* and 64*c* each aligned with a respective curvilinear enlarged portion of the chain link shaped first and second elongated common beam passing apertures 61 and 62 which are arranged in common alignment. Referring to FIG. 2*b*, there is shown partially in phantom a perspective view of the G4 grid incorporated in the bipotential electron gun 50 of FIG. 2. As shown in FIG. 2*b*, the first common beam passing aperture 61 in the G4 grid includes three inline curvilinear portions, each aligned with a respective one of the inner beam passing aperture 64*a*, 64*b* and 64*c* located in the G4 grid. The second elongated common beam passing aperture 62 located in an inner portion of the G4 grid has a size and shape similar to that of the first elongated common beam passing aperture 61. As in the case of the prior art bipotential inline electron gun 10 shown in FIG. 1, a conductive support cup 26 is affixed to the upper end portion of the G4 grid and a glass display screen 42 is disposed in spaced relation from the bipotential inline electron gun 50 for receiving the scanning electron beams and providing a video image as previously described. Other elements of the inventive bipotential inline electron gun 50 shown in FIG. 2 common to corresponding elements shown in FIG. 1 are assigned the same identifying numbers, although these conventional CRT and electron gun elements are not described herein for simplicity.

Figure 6A:
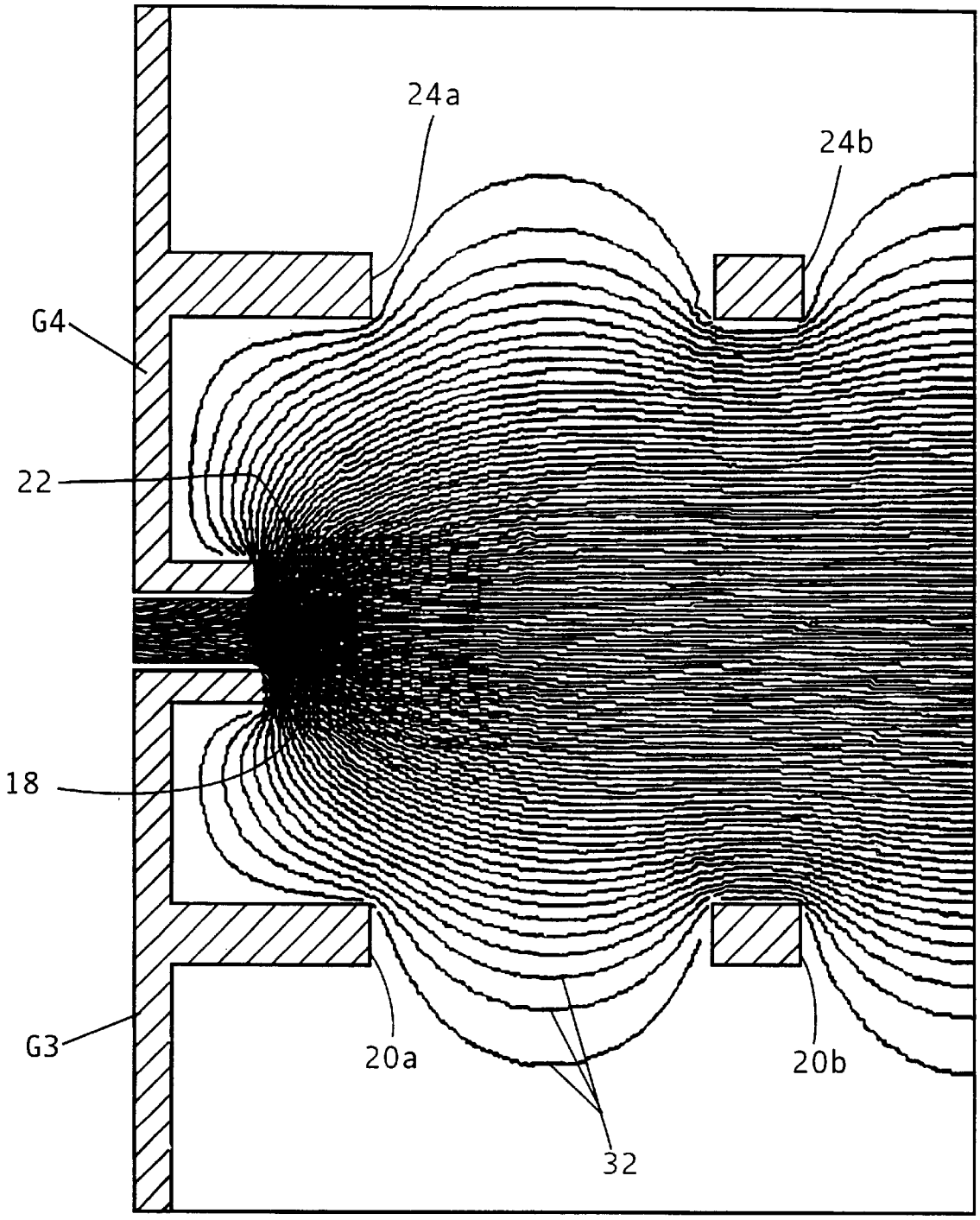
FIG.6a (PRIOR ART)
FIGS. 6*a* and 6*b* are partial sectional views of the prior art electron gun of FIG. 1 respectively taken in the XZ-plane and the YZ-plane showing the equipotential lines in a portion of the electron gun, as determined by a computer program, where the view shown in FIG. 6*b* is taken along site line 6*b*—6*b* in FIG. 1 and the view shown in FIG. 6*a* is in the plane of the figure.
Figure 6B:
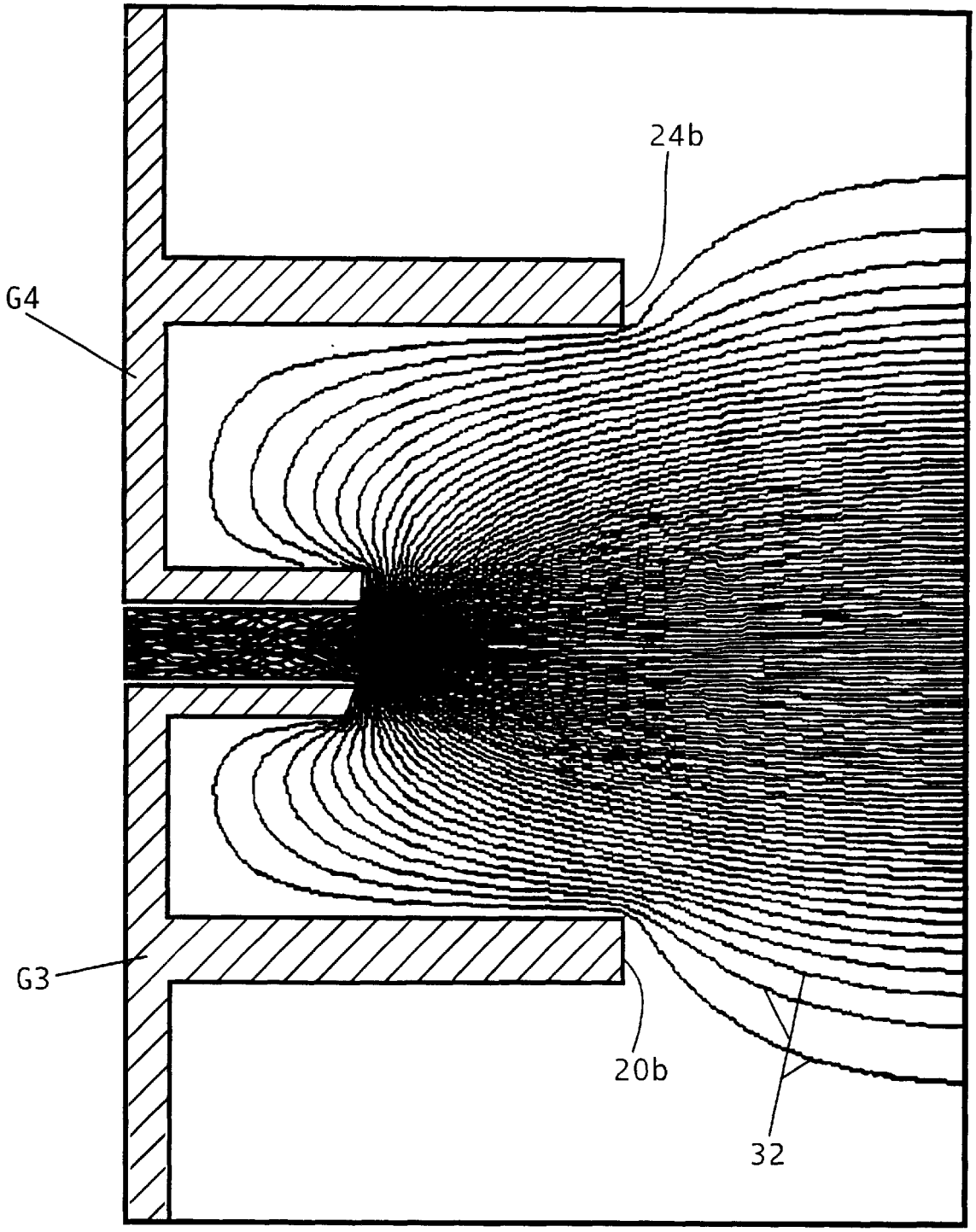
FIG.6b (PRIOR ART)

Referring to FIGS. 6*a* and 6*b*, there are respectively shown partial sectional views of the prior art electron gun 10 of FIG. 1 respectively taken in the XZ-plane and the YZ-plane showing the equipotential lines 32 in a portion of the electron gun. The location of the equipotential lines 32 shown in FIGS. 6*a* and 6*b* was determined by means of a computer simulation program. The view shown in FIG. 6*b* is taken along site line 6*b*—6*b* in FIG. 1, while the view shown in FIG. 6*a* is taken at the same location in the electron gun, but is in the plane of FIG. 1. Adjacent portions of the G3 and G4 grids in the prior art electron gun 10 are shown in the partial sectional views of FIGS. 6*a* and 6*b* where the common electron beam passing apertures 18 and 22 are shown in facing relation. Also shown in the partial sectional views of FIGS. 6*a* and 6*b* are beam passing apertures 20*a* and 20*b* in the G3 grid and beam passing apertures 24*a* and 24*b* in the G4 grid. The third beam passing aperture in each of these grids is not shown in these figures for simplicity. Each of the electron beams travels first through the G3 grid and then through the G4 grid, or in an upward direction as viewed in the sectional views of these figures. Thus, separate electron beams transit the beam passing apertures 20*a* and 20*b* (as well as the third beam passing aperture which is not shown in FIGS. for simplicity) and then transit the elongated common beam passing aperture 18 in the G3 grid. Electron beams then transit the elongated common beam passing aperture 22 in the G4 grid and the electron beam passing apertures 24*a* and 24*b*. The equipotential lines 38 represent the electrostatic focus field applied by the G3 and G4 grids to the electron beams. The outer equipotential lines 32 generally conform with the inner surfaces of the conductive G3 and G4 grids between the three inline electron beam passing aperture arrays in each of these grids. The intensity of the electrostatic focusing field is greatest in the space between the G3 and G4 grids, with the inner equipotential lines more closely spaced than the outer equipotential lines to represent this change in electrostatic focusing intensity on the electron beams.

Figure 7A:
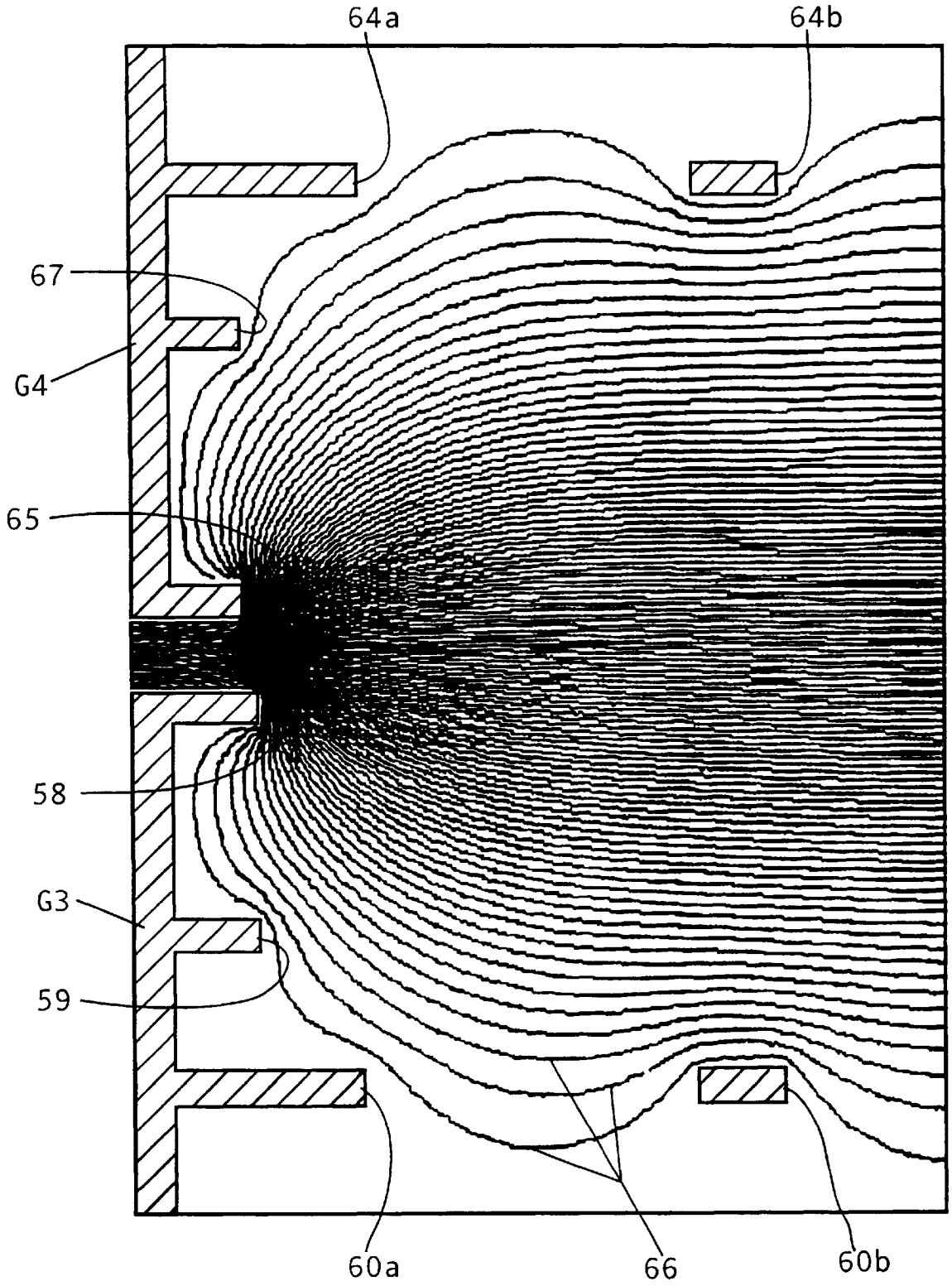
FIGS. 7*a* and 7*b* are partial sectional views of the inventive electron gun shown in FIG. 2 respectively taken in the XZ-plane and in the YZ-plane showing the equipotential lines in a portion of the electron gun, as determined by a computer program, where the view shown in FIG. 7*b* is taken along site line 7*b*—7*b* in FIG. 2 and the view shown in FIG. 7*a* is in the plane of the figure.
Figure 7B:
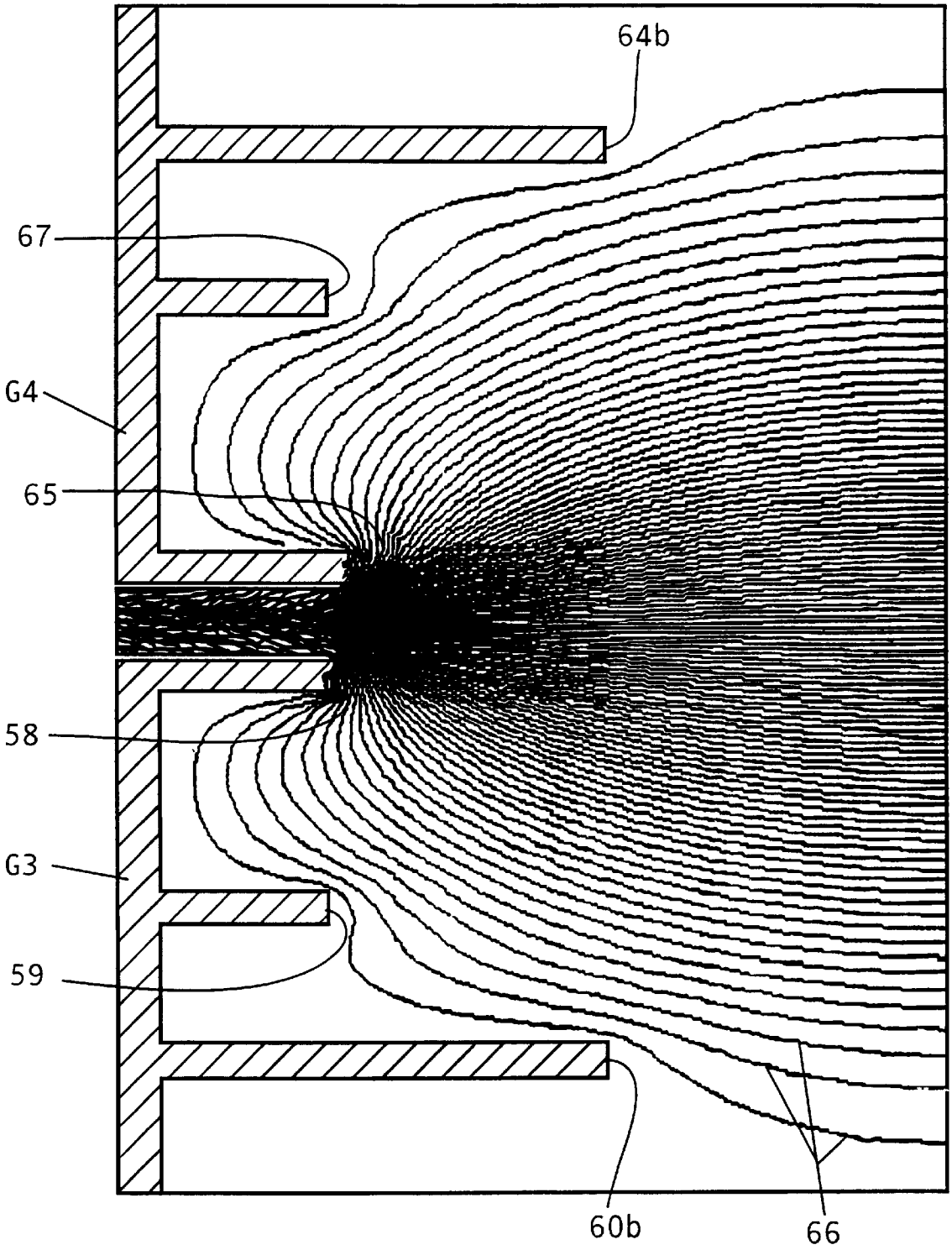

Referring to FIGS. 7*a* and 7*b*, there are shown partial sectional views of the inventive electron gun shown in FIG. 2 respectively taken in the XZ-plane and the YZ-plane showing the equipotential lines in a portion of the electron gun. The location of the equipotential lines shown in these figures were also calculated using a computer program. The view shown in FIG. 7*b* is taken along site line 7*b*—7*b* in FIG. 2, while the view shown in FIG. 7*a* is in the plane of the figure. The electron beams first transit the G3 grid and then the G4 grid in traveling toward the CRT's display screen. As shown in these figures, the outer equipotential lines 66 closely conform to the inner surfaces of the G3 and G4 grids between the three inline beam passing aperture arrays in each of these grids. The electrostatic focusing field applied to the three electron beams is greatest in the region between the G3 and G4 grids where the equipotential lines are most closely spaced. In the inventive electron gun as shown in FIGS. 7*a* and 7*b*, the inclusion of the inner common beam passing apertures in the form of the second elongated common beam passing aperture 59 within the G3 grid and the second elongated common beam passing aperture 67 within the G4 grid extend the length of the electron beam focus field along the X-axis, i.e., in the direction toward the CRT's display screen, of the electron gun. A comparison of FIGS. 6*a* and 6*b* with FIGS. 7*a* and 7*b* shows that the equipotential lines 66 formed by the G3 and G4 grids in accordance with the present invention are elongated in the direction of travel of the electron beams as compared with the electron beam focus field shown by the equipotential lines 32 of the prior art electron gun in FIGS. 6*a* and 6*b*. Incorporating the multi-layer common lens arrangement of the present invention in the G3 and G4 grids as shown in FIGS. 7*a* and 7*b* has the effect of lengthening the main focus lens of the electron gun along its longitudinal axis. The equipotential lines 66 shown in FIGS. 7*a* and 7*b* also more closely approach the shape of the inner surfaces of the G3 and G4 grids than the equipotential lines of the prior art electron gun. This increases the effective diameter of the electron gun's main focus lens. By increasing the length of the electrostatic focusing field along the electron gun's Z-axis, astigmatism arising from an increase in the effective diameter of the electrostatic focus lens in the XY-plane is compensated for and essentially eliminated. The multi-layer common lens arrangement of the present invention thus achieves improved video image resolution by improving electron beam focusing by increasing the effective size of the electron gun's main focus lens without increasing its physical size. The present invention represents an improvement over prior attempts to improve video image resolution which increased the depth of the common lens as well as its equivalent diameter, but were unable to correct for the large astigmatism typically encountered.

Figure 4:
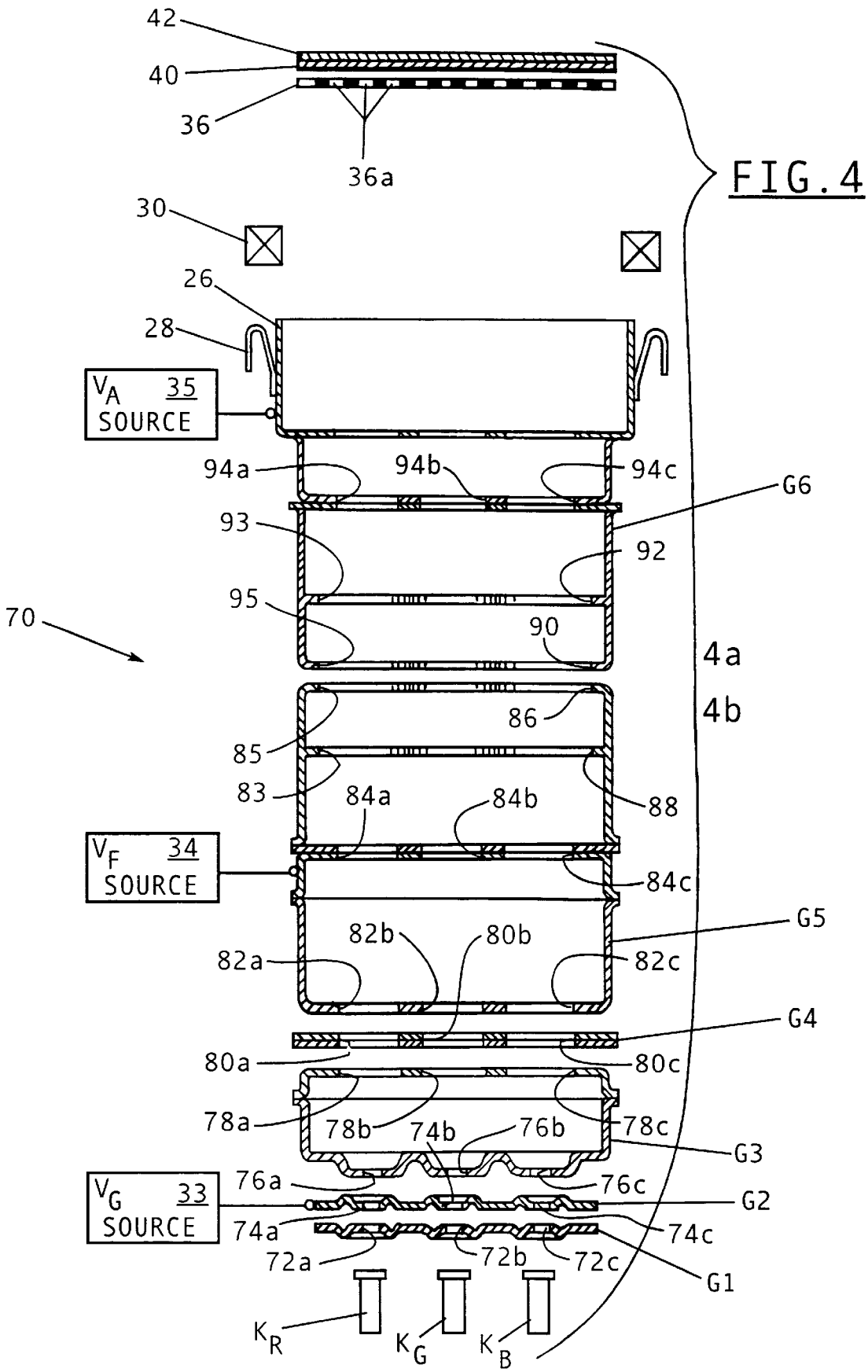
FIG. 4 is a longitudinal sectional view of an electron gun having a quadrupole lens and incorporating a multi-layer common aperture arrangement in its main focus lens in accordance with another embodiment of the present invention.
Figure 5:
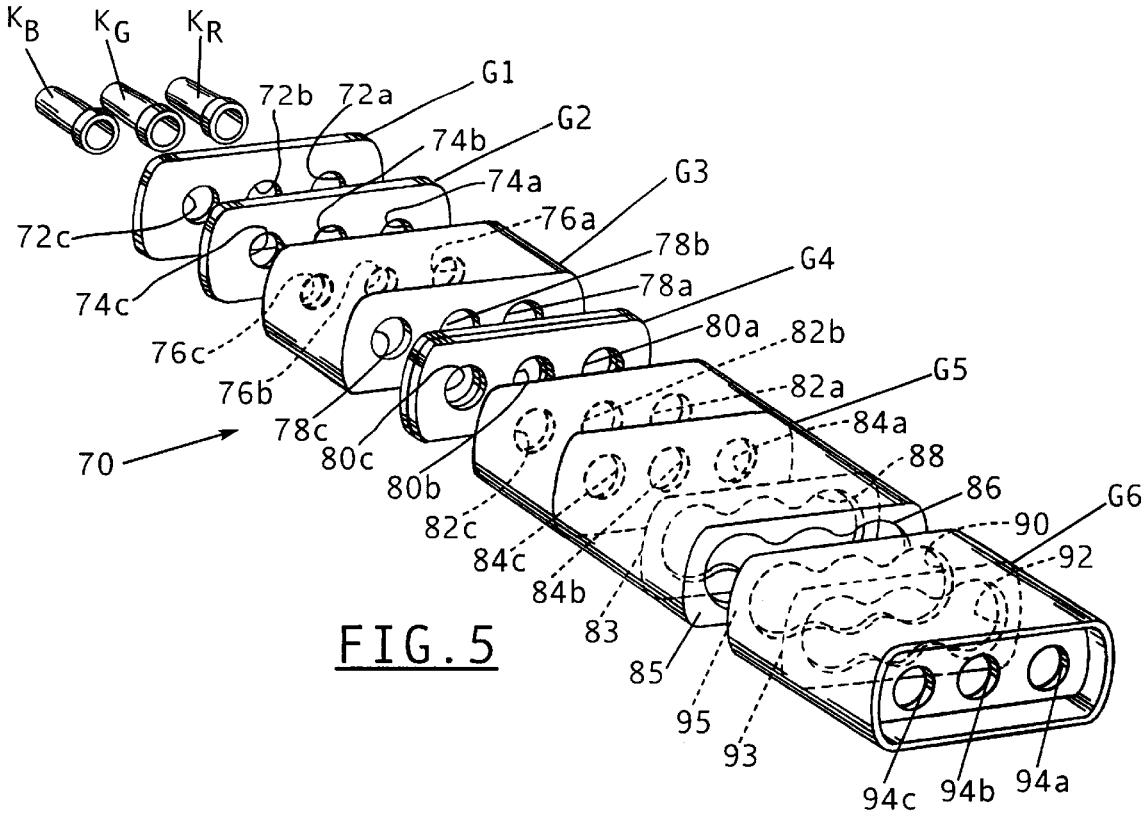
FIG. 5 is a partial perspective view shown partially in phantom of the inventive QPF-type electron gun shown in FIG. 4.

Referring to FIG. 4, there is shown a longitudinal sectional view of a quadrupole focusing (QPF)-type electron gun 70 incorporating a multi-layer common lens arrangement in accordance with another embodiment of the present invention. A partial perspective view shown partially in phantom of the QPF-type electron gun 70 is shown in FIG. 5. As in the previously described embodiment, the QPF-type electron gun 70 includes three cathodes $K_R$, $K_G$ and $K_B$, each of which directs respective groups of energetic electrons toward three inline apertures 72*a*, 72*b* and 72*c* in the electron gun's G1 control grid. The electron gun 70 further includes a G2 screen grid also having three inline electron beam passing apertures 74*a*, 74*b* and 74*c* each aligned with a respective one of the apertures in the G1 control grid. A G3 grid includes three inline apertures 76*a*, 76*b* and 76*c* on its lower portion in facing relation with the G2 screen grid. The G1 control and G2 screen grids in combination with the lower portion of the G3 grid comprise the beam forming region of QPF-type electron gun 70. The G3 grid further includes three inline beam passing apertures 78*a*, 78*b* and 78*c* in its upper end portion in facing relation to a G4 grid. The G4 grid also includes three inline beam passing apertures 80*a*, 80*b* and 80*c*. The G4 grid in combination with an upper portion of the G3 grid forms a prefocus lens of the. QPF-type electron gun 70. Electron gun 70 further includes a $G_5$ grid having on a lower end portion thereof three inline beam passing apertures 82*a*, 82*b* and 82*c* in facing relation to the G4 grid. The G5 grid further includes three inner inline beam passing apertures 84*a*, 84*b* and 84*c*, each of which is aligned with a respective one of the inline beam passing apertures in the G3 and G4 grids as well as with the inline beam passing apertures in the G1 control and G2 screen grids.

In accordance with this embodiment of the present invention, an upper end portion of the G5 grid includes a first elongated common beam passing aperture 86 disposed in an end wall 85 and an inner second elongated common beam passing aperture 88 disposed in an inner wall 83 within the G5 grid. Each of the first and second elongated common beam passing apertures 86, 88 is provided with three enlarged, curvilinear portions each aligned with a respective one of the inner beam passing apertures 84*a*, 84*b* and 84*c* within the G5 grid. Also in accordance with this embodiment of the present invention, a lower portion of a G6 grid in facing relation to the upper portion of the G5 grid includes a first elongated common beam passing aperture 90 disposed in an end wall 95. The G6 grid further includes an inner second elongated common beam passing aperture 92 disposed in spaced relation from the first elongated common beam passing aperture 90. The inner second elongated common beam passing aperture 92 is disposed in an inner wall 93 within the G6 grid. Also disposed in the G6 grid are three inline, spaced, generally circular beam passing apertures 94*a*, 94*b* and 94*c* each adapted to pass a respective electron beam as it travels toward and is incident upon the CRT's glass display screen 42. The G5 and G6 grids form the main focus lens of QPF-type electron gun 70.

Figure 4A:
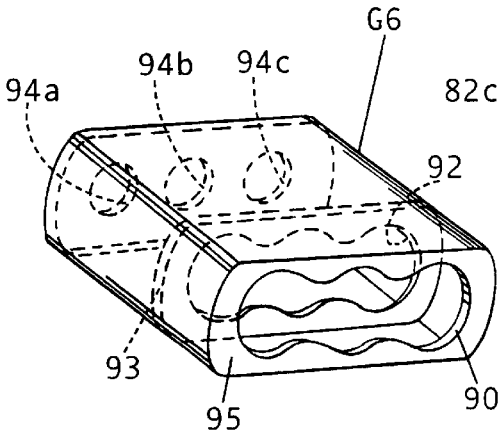
FIGS. 4*a* and 4*b* are perspective views, shown partially in phantom, respectively of the G6 and G5 grids used in the QPF electron gun of FIG. 4.

Referring to FIG. 4*a*, there is shown another sectional view of the QPF-type electron gun 70 shown in FIG. 4 taken along site line 4*a*—4*a* therein. As shown in FIG. 4*a*, the first elongated common beam passing aperture 90 in the lower portion of the G6 grid is chain link shaped having three enlarged, curvilinear portions disposed along its length in a spaced manner. Each enlarged portion of the first elongated common beam passing aperture 90 is aligned with a respective one of the generally circular electron beam passing apertures 94*a*, 94*b* and 94*c* disposed in an inner portion of the G6 grid. The second elongated common beam passing aperture 92 disposed in an inner portion of the G6 grid is essentially the same size and shape as the first elongated common beam passing aperture 90, although this is not shown in FIG. 4*a* because the second elongated common beam passing aperture is disposed behind the first elongated common beam passing aperture in this view of the G6 grid.

Figure 4B:
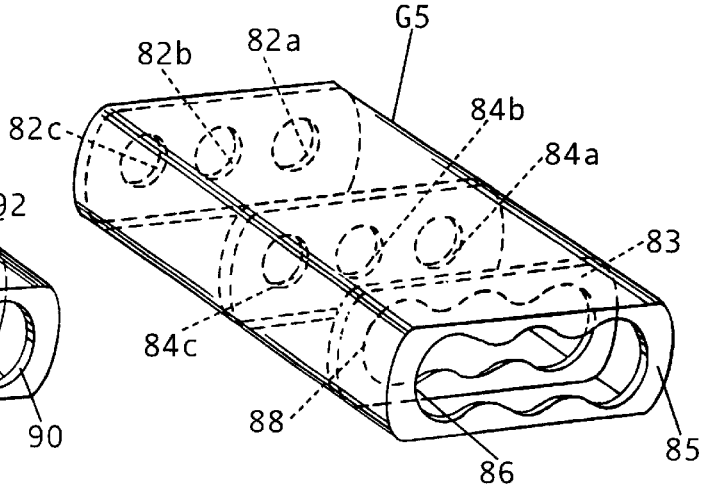

Referring to FIG. 4*b*, there is shown a sectional view of the QPF-type electron gun 70 shown in FIG. 4 taken along site line 4*b*—4*b* therein. As shown in FIG. 4*b*, the first elongated common beam passing aperture 86 in the upper end portion of the G5 grid is chain link shaped having three enlarged, curvilinear portions disposed along its length in a spaced manner. Each enlarged portion of the first elongated common beam passing aperture 86 is aligned with the respective one of the generally circular electron beam passing apertures 84*a*, 84*b* and 84*c* disposed in an inner portion of the G5 grid. The second elongated common beam passing aperture 88 within the G5 grid cannot be seen in the sectional view of FIG. 4*a* as the second elongated beam passing aperture is disposed aft of, or behind, the first elongated common beam passing aperture 86 in the view of the G5 grid. First and second elongated common beam passing apertures 86 and 88 within the G6 grid are substantially the same size and shape.

There has thus been shown a multi-layer common lens arrangement for the main focus lens of a multi-beam electron gun which allows for increasing the size of the electron gun, either both physically and equivalently, to provide improved focusing of the electron beams incident upon a CRT display screen for presenting a video image thereon. The multi-layer common lens arrangement is disposed in one or more focusing grids within the electron gun's main focus lens and is in the form of a pair of aligned, elongated apertures within the grid through which the three electron beams are directed for focusing. Although the present invention is described herein in the form of a pair of aligned elongated common beam passing apertures disposed within each of adjacent charged grids in the main focus lens, virtually any number of aligned common beam passing apertures may be disposed in one or more charged grids in the electron gun's main focus lens. The common beam passing apertures may take on various forms such as the chain link shape including three, curvilinear, spaced portions arranged along the length of the grid through which the three electron beams are directed as described above. Other common forms that the elongated common beam passing aperture may take include the dog bone, race track and elliptical shapes. While increasing the length of the electron gun, the present invention does not require an increase in the diameter of the electron gun, thus making an electron gun incorporating the present invention compatible with the narrow neck portion of conventional CRT glass envelopes.

While particular embodiments of the present invention have been shown and described, it will be obvious to those skilled in the relevant art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A charged electrode in an electron gun forming an electrostatic focusing field for focusing plural electron beams on a display screen of a color cathode ray tube (CRT) in forming a video image on said screen, wherein said plural electron beams are directed along respective parallel axes, said electrode comprising:

a hollow housing including first wall means for defining three inline apertures and a thin side wall forming lateral portions of said housing, wherein each of said inline apertures is aligned with a respective one of said axes for passing a respective one of said electron beams;

plural second wall means disposed in said hollow housing and extending inwardly toward the electron beam axes from said side wall, wherein said plural second wall means are disposed in a spaced manner along the electron beam axes; and means defining an elongated common aperture in each of said second wall means, wherein said common apertures are aligned in a spaced manner along the electron beam axes and the electron beams are directed through said aligned common apertures, and wherein said plural wall means increase the effective radius of the electrostatic focusing field of the electrode and the length of the electrostatic focusing field along said axes for improved electron beam focusing on the display screen.

2. The electrode of claim 1 wherein said electron gun includes a main focus lens and wherein said electrode is disposed in said main focus lens.

3. The electrode of claim 2 comprising a G3, G4, G5 or G6 grid in the electron gun.

4. The electrode of claim 1 wherein said elongated common aperture is chain link, dog bone, race track or elliptical in shape.

5. The electrode of claim 1 wherein each of said inline apertures is generally circular.

6. The electrode of claim 1 wherein one of said second wall means and an elongated common aperture therein is disposed on an end of said hollow housing.

7. A charged electrode in an electron gun forming an electrostatic focusing field for focusing a center and two outer electron beams on a display screen of a color cathode ray tube (CRT) in forming a video image on said screen, wherein said three electron beams are directed along respective parallel axes, said electrode comprising:

a hollow housing including first wall means for defining three inline apertures and a thin side wall forming lateral portions of said housing, wherein each of said inline apertures is aligned with a respective one of said axes for passing a respective one of said electron beams;

second wall means disposed on an end of said hollow housing and extending inwardly toward the electron beam axes from said side wall for defining a first elongated common aperture aligned generally transverse to said axes, wherein the center and two outer electron beams are directed through said first elongated common aperture; and third wall means disposed within said hollow housing between said first and second wall means and extending inwardly toward the electron beam axes from the side wall for defining a second elongated common aperture aligned with said first elongated common aperture for passing the center and two outer electron beams, wherein said second and third wall means increase the effective electrostatic focusing field radius of the electrode and the length of the electrostatic focusing field along said axes for improved electron beam focusing on the display screen.

8. The electrode of claim 7 wherein said elongated common aperture is chain link, dog bone, race track or elliptical in shape.

9. The electrode of claim 7 wherein each of said first and second common apertures is generally chain link shaped and has a center enlarged portion and first and second outer enlarged portions each aligned with a respective electron beam axis for passing said center and two outer electron beams, respectively.

10. The electrode of claim 9 wherein said three inline apertures include a center aperture and two outer apertures disposed on opposed sides of said center aperture, and wherein said center and two outer apertures are aligned respectively with the center enlarged portion and the first and second outer enlarged portions of said first and second common apertures.

11. The electrode of claim 10 wherein said inline apertures and the enlarged portions of said first and second common apertures are generally circular.

12. The electrode of claim 7 wherein said electrode is disposed in a prefocus lens or a main focus lens of the electron gun and is charged by a focus voltage or an anode voltage.

13. For use in an electron gun in a multi-electron beam video display device, wherein said electron beams are directed along respective parallel axes onto a display screen for providing a video image thereon, a focus lens through which said electron beams are directed for focusing the electron beams on the display screen, said focus lens comprising:

a first charged grid including a first hollow housing with first and second opposed ends and a first thin side wall disposed about said first housing and forming lateral portions thereof, said first charged grid further including first plural wall means disposed in said first hollow housing in a spaced manner along the electron beam axes and extending inwardly toward the electron beam axes from said side wall for defining first plural spaced common apertures, and wherein said first plural common apertures are aligned with the electron beam axes for passing the electron beams; and a second charged grid including a second hollow housing with first and second opposed ends and a second thin side wall disposed about said second housing and forming lateral portions thereof, said second charged grid further including second plural wall means disposed in said second hollow housing in a spaced manner along the electron beam axes and extending inwardly toward the electron beam axes from said second side wall for defining second plural spaced common apertures, and wherein said second plural common apertures are aligned with the electron beam axes for passing the electron beams and said first and second plural common apertures are in facing relation.

14. The focus lens of claim 13 wherein said first and second charged grids further respectively include third and fourth wall means defining first and second sets of plural inline apertures, respectively, and wherein each of said inline apertures passes a respective one of the electron beams.

15. The focus lens of claim 14 wherein said video display device includes three inline electron beams and each of said charged grids includes three inline apertures, and wherein each inline aperture in each of said grids passes a respective electron beam.

16. The focus lens of claim 15 wherein each of said elongated apertures is generally chain link shaped having a center enlarged portion and first and second outer enlarged portions each aligned with a respective electron beam axis for passing a center and an outer electron beam, respectively.

17. The focus lens of claim 16 wherein each of said first and second sets of three inline apertures includes a center aperture and two outer apertures disposed on opposed sides of said center aperture, and wherein each of said center apertures and two outer apertures are aligned with the center enlarged portion and the first and second outer enlarged portions of said elongated common apertures, respectively.

18. The focus lens of claim 17 wherein said inline apertures and the enlarged portions of each of said elongated common apertures are generally circular.

19. The focus lens of claim 18 wherein said first and second charged grids are charged by either a focus voltage or an anode voltage.

* * * * *

UNITED STATES PATENT AND TRADEMARK OFFICE

CERTIFICATE OF CORRECTION

PATENT NO. : 6,674,228 B2
DATED : January 6, 2004
INVENTOR(S) : Hsing Yao Chen et al.

It is certified that error appears in the above-identified patent and that said Letters Patent is hereby corrected as shown below:

Title page,
Item [73], Assignee, change "Pictures" to -- Picture --

Signed and Sealed this

Tenth Day of August, 2004

JON W. DUDAS
*Acting Director of the United States Patent and Trademark Office*